US005952900A

United States Patent [19]

Hoang et al.

[11] Patent Number: 5,952,900

[45] Date of Patent: Sep. 14, 1999

[54] SUPPRESSION OF SPURIOUS CAVITY MODES USING RESISTIVE PASTE ON A CERAMIC TRANSVERSE-ELECTROMAGNETIC-MODE (TEM) FILTER

[75] Inventors: Truc Hoang, Rio Rancho; Reddy Vangala, Albuquerque, both of N.Mex.; Antonije Djordjevic, Belgrade, Yugoslavia

[73] Assignee: CTS Corporation, Elkhart, Ind.

[21] Appl. No.: 08/982,545

[22] Filed: Dec. 2, 1997

[51] Int. Cl.[6] ..... H01P 1/205; H01P 5/12

[52] U.S. Cl. ..... 333/206; 333/207; 333/134

[58] Field of Search ..... 333/202, 206, 333/207, 222, 223, 251, 81 A, 126, 134, 129

[56] References Cited

U.S. PATENT DOCUMENTS

| | | | |
|---|---|---|---|
| 4,344,053 | 8/1982 | Anderson | 333/251 |
| 5,150,089 | 9/1992 | Komazaki et al. | 333/206 |
| 5,416,454 | 5/1995 | McVeety | 333/204 |
| 5,436,602 | 7/1995 | McVeety et al. | 333/206 |
| 5,537,085 | 7/1996 | McVeety | 333/206 |

*Primary Examiner*—Seungsook Ham
*Attorney, Agent, or Firm*—Jones, Day, Reavis & Pogue

[57] ABSTRACT

A ceramic transverse-electromagnetic-mode filter having a resistive paste base and resistive paste layer and method of tuning same is provided. The ceramic filter includes a filter body (200) comprising a block of dielectric material and having top (202), bottom (204) and four side surfaces (206, 208, 210, 212) including vertical edges (214). The filter also has metallized through-holes providing transverse-electromagnetic-mode resonators (210). At least one vertical portion in proximity to the vertical edges (214) of the block on at least one of the side surfaces is unmetallized providing a resistive paste base (218). A resistive paste layer (219) of predetermined resistivity is deposited thereon. The resistive paste layer attenuates a set of parasitic spurious responses in the filter frequency response curve while simultaneously maintaining a desired transverse-electromagnetic-mode passband.

13 Claims, 5 Drawing Sheets

SUPPRESSION OF SPURIOUS CAVITY MODES USING RESISTIVE PASTE ON A CERAMIC TRANSVERSE-ELECTROMAGNETIC-MODE (TEM) FILTER

FIELD OF THE INVENTION

This invention relates generally to filters, and in particular to the suppression of spurious cavity modes using resistive paste on a ceramic transverse-electromagnetic-mode filter.

BACKGROUND OF THE INVENTION

Filters are known to provide attenuation of signals having frequencies outside of a particular frequency range and little attenuation to signals having frequencies within the particular frequency range of interest. As is also known, these filters may be fabricated from ceramic materials having one or more transverse-electromagnetic-mode (hereafter "TEM-mode") resonators coupled together and formed therein. TEM-mode means that the electric and magnetic fields are in a direction that is perpendicular to the direction of wave propagation in a filter block. A ceramic filter may be constructed to provide a lowpass filter, a bandpass filter, a bandstop filter, or a highpass filter, for example.

FIG. 1 shows a representative prior art ceramic monolithic block filter 100. This filter contains a series of resonators 102 which extend from a top surface 104 to a bottom surface 106 of the block. The resonators 102 are capacitively coupled to an input pad 108 and an output pad 110. All external surfaces of the filter 100 are substantially covered with a conductive metallization coating with an exception of an area 112 surrounding the input pad 108 and the output pad 110 as well as an area 114 surrounding the resonators 102 on the top surface 104 of the filter block 100. It is notable that the metallization layer provides a substantially encapsulated casing for the energy which flows through the filter block 100.

At the design passband, the filter structure dominantly supports TEM-mode waves. Hence, the filter properties can be well predicted using the theory of TEM guided waves and telegrapher's equations relating to transmission line theory during modeling operations. However, away from the design passband, all filters have more or less pronounced parasitic passbands and other regions of poor attenuation. These problematic parasitic passbands are usually more obvious above the design passband, but they may also be present below the design passband. From a practical standpoint, these parasitic passbands may cause particular problems if they coincide with the 2nd and 3rd harmonics of the fundamental transmitter frequency, as strong harmonics of the transmitter frequency may be fed into the antenna.

The potential problems presented by these unwanted parasitic passbands cannot be understated. Oftentimes, these passbands will result in interference or unwanted noise in the signal. If the interference is sufficiently strong, it may result in the telephone call in the cellular system being dropped. Additionally, the transmission of harmonics at higher frequencies may create issues for a telecommunications provider which may have to be dealt with by the Federal Communication Commission (FCC).

Consequently, many designers of systems such as cellular telephones need additional attenuation over that provided by traditional ceramic monolithic block filters. To address this problem, designers oftentimes place a second lowpass filter in-line to suppress unwanted harmonic responses. This solution, unfortunately, is both expensive and time consuming, and may significantly add to the cost weight, and part-count of a completed product such as a cellular telephone, pager, or other electronic signal processing apparatus.

Another solution to the problem of unwanted parasitic passbands is to add lumped components to the printed circuit board, thereby creating an additional filter assembly which properly couples to the original filter and eliminates the unwanted higher frequencies. This solution is also expensive, labor intensive, and time consuming.

A ceramic filter design which addresses the problem of harmonic response suppression by attenuating the unwanted passbands through the introduction of a strategically positioned resistive paste deposit on an exterior surface of the dielectric block of ceramic without the addition of a second filter or lumped elements may result in a substantial savings in both space and cost. A ceramic transverse-electromagnetic-mode filter having a resistive paste design which suppresses unwanted parasitic passbands and spurious modes would be considered an improvement in the art.

DETAILED DESCRIPTION OF THE PREFERRED EMBODIMENT

Figure 2A:
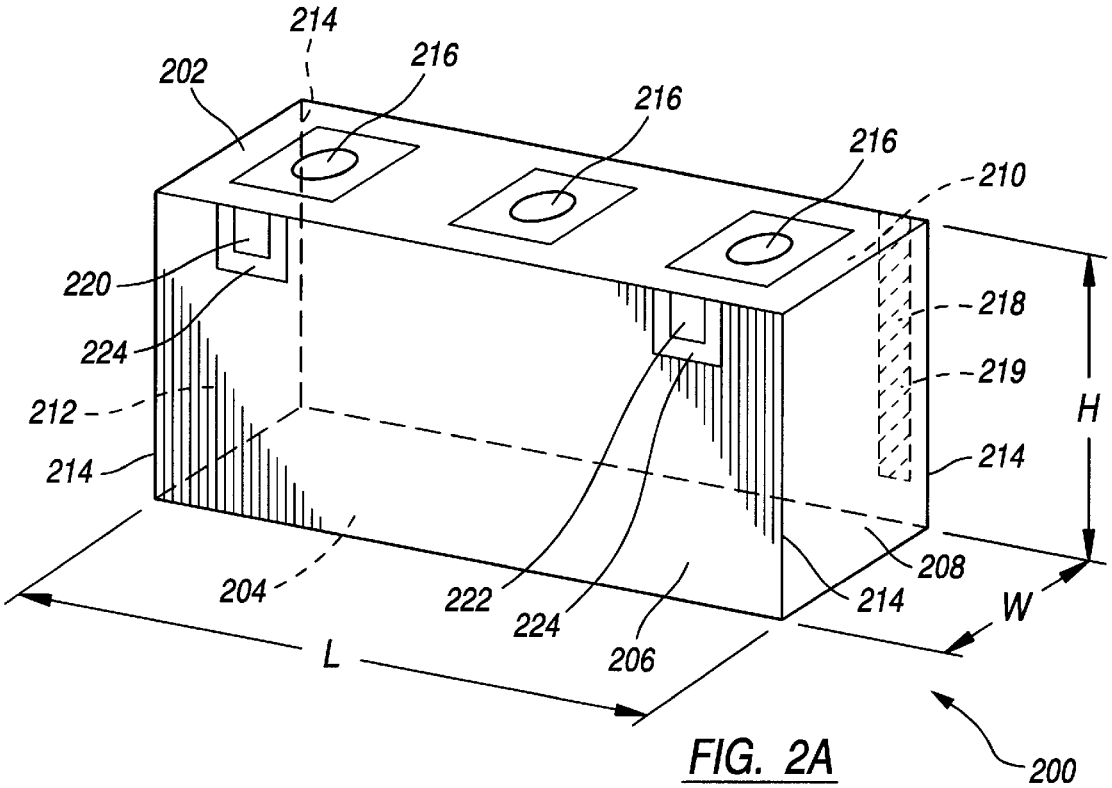
FIG. 2A shows a rear view of a ceramic transverse-electromagnetic-mode filter having suppression of spurious cavity modes using resistive paste, in accordance with the present invention.

FIG. 2A shows a rear view of a ceramic filter having a resistive paste base. Deposited directly on top of the resistive paste base is a layer of resistive paste which causes suppression of spurious cavity modes on the ceramic transverse-electromagnetic-mode (TEM) filter. Referring to FIG. 2A, a ceramic filter 200 is provided. Filter 200 includes a filter body made from a block of dielectric material and having a top surface 202, a bottom surface 204, and four side surfaces 206, 208, 210 and 212 respectively. Filter 200 also includes four vertical edges 214. A plurality of metallized through-holes extending from the top surface 202 to the bottom surfaces 204 define transverse-electromagnetic-mode resonators 216.

The external surfaces 204, 206, 208, 210 and 212 are substantially covered with a conductive material defining a metallized layer, with the exception that the top surface 202 is substantially uncoated. Additionally, at least one vertical portion in proximity to the vertical edges 214 of the block 200 on at least one of the side surfaces is unmetallized defining a resistive paste base 218. A resistive paste layer 219 is deposited directly on top of the resistive paste base 218. The resistive paste base (also referred to as "the base") is represented with dashed lines in FIG. 2A. The resistive paste base 218 and the resistive paste layer 219 (also called a resistive strip or strip of resistance) together provide the suppression of spurious cavity modes on the transverse-electromagnetic-mode (TEM) filter.

The resistive paste base 218 extends substantially vertically in proximity to a vertical edge 214 of the block 200 and with a substantially uniform width. Base 218 extends parallel to the resonators 216 a distance to attenuate a set of parasitic spurious responses (unwanted parasitic passbands) in the filter frequency response curve while simultaneously maintaining a desired transverse-electromagnetic-mode (TEM-mode) passband (see FIG. 6 discussed below).

First and second input-output pads (220, 222 respectively) comprising an area of conductive material on at least one of the side surfaces and substantially surrounded by an uncoated area of the dielectric material 224 are also shown in FIG. 2A. Finally, FIG. 2A shows the height (h), width (w), and length (L) dimensions of the dielectric block of ceramic.

Figure 2B:
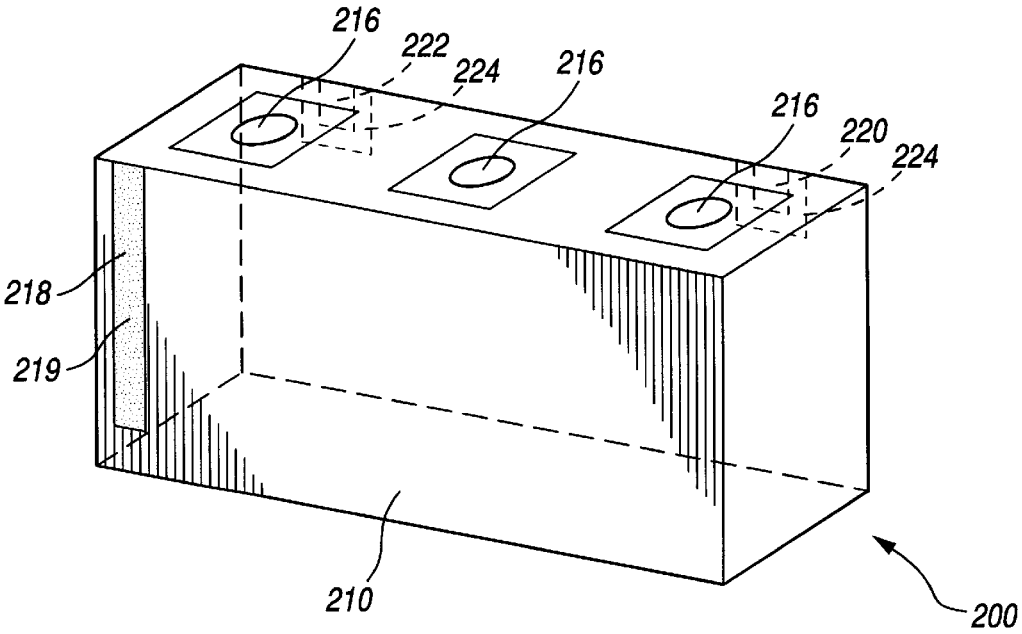
FIG. 2B shows a front view of the ceramic transverse-electromagnetic-mode filter of FIG. 2A, in accordance with the present invention.

FIG. 2B shows a front view of the ceramic transverse-electromagnetic-mode (TEM) filter having a resistive paste base and resistive paste layer of FIG. 2A. Similar to FIG. 2A, this view shows filter 200 having TEM-mode resonators 216, as well an electrical input pad 220 and an electrical output pad 222, both surrounded by an unmetallized area of dielectric material 224. This view also clearly shows the resistive paste base 218, Significantly, this view also shows the resistive paste layer 219, which is an important part of the present invention and is represented with a solid line on the front surface 210 of the filter block 200.

Figure 3:
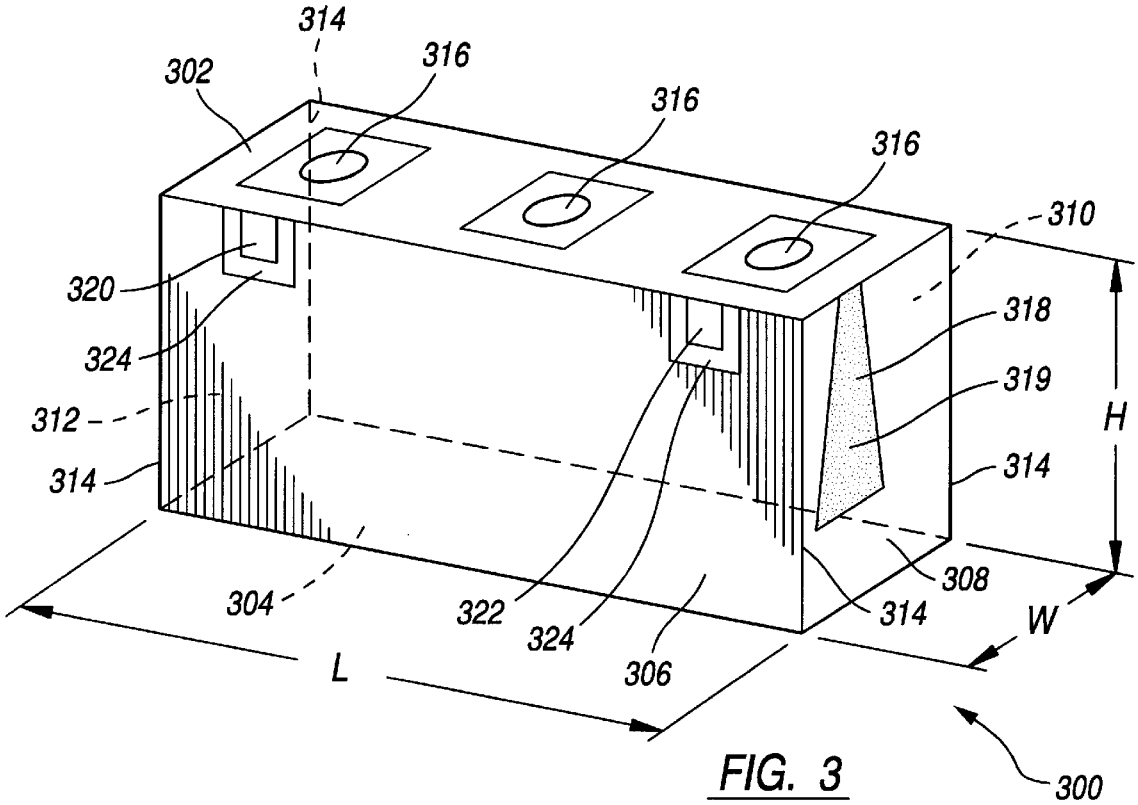
FIG. 3 shows another embodiment of the ceramic transverse-electromagnetic-mode filter having suppression of spurious cavity modes using resistive paste, in accordance with the present invention.

FIG. 3 shows another embodiment of the present invention in which a resistive paste base 318 and a resistive paste layer 319 is on another side surface 308 of filter 300. (This is compared to FIG. 2 wherein the resistive paste layer 219 is on a front surface 210 of the filter block.) Referring to FIG. 3, a ceramic filter 300 is provided. Filter 300 includes a filter body made from a block of dielectric material and having a top surface 302, a bottom surface 304, and four side surfaces 306, 308, 310 and 312 respectively. Filter 300 also includes four vertical edges 314. A plurality of metallized through-holes extending from the top 302 to the bottom surfaces 304 define TEM-mode resonators 316.

The external surfaces 304, 306, 308, 310 and 312 are substantially covered with a conductive material defining a metallized layer, with the exception that the top surface 302 is substantially uncoated. Additionally, at least one vertical portion in proximity to the vertical edges 314 of the block 300 on at least one of the side surfaces is unmetallized defining a resistive paste base 318. Deposited directly on top of the resistive paste base 318 is a layer of resistive paste 319 which causes suppression of spurious cavity modes on the ceramic transverse-electromagnetic-mode (TEM) filter. The properties and characteristics of the resistive paste layer 319 will be discussed in greater detail below.

The resistive paste base 318 extends substantially vertically in proximity to the vertical edges 314 of the block 300 and with a substantially uniform width. Base 318 extends parallel to the resonators 316 a distance sufficient to attenuate a set of parasitic spurious responses in the filter frequency response curve while simultaneously maintaining a desired TEM-mode passband (see FIG. 6 discussed below).

It should be noted that in FIG. 3, resistive paste layer 319 is located on side surface 308 of the filter block 300. Resistive paste layer 319 may be located on any of the four side surface 306, 308, 310, or 312. In a preferred embodiment, resistive paste layer 319 will be located in proximity to one of the vertical edges 314 and extend substantially parallel to resonators 316.

Figure 4:
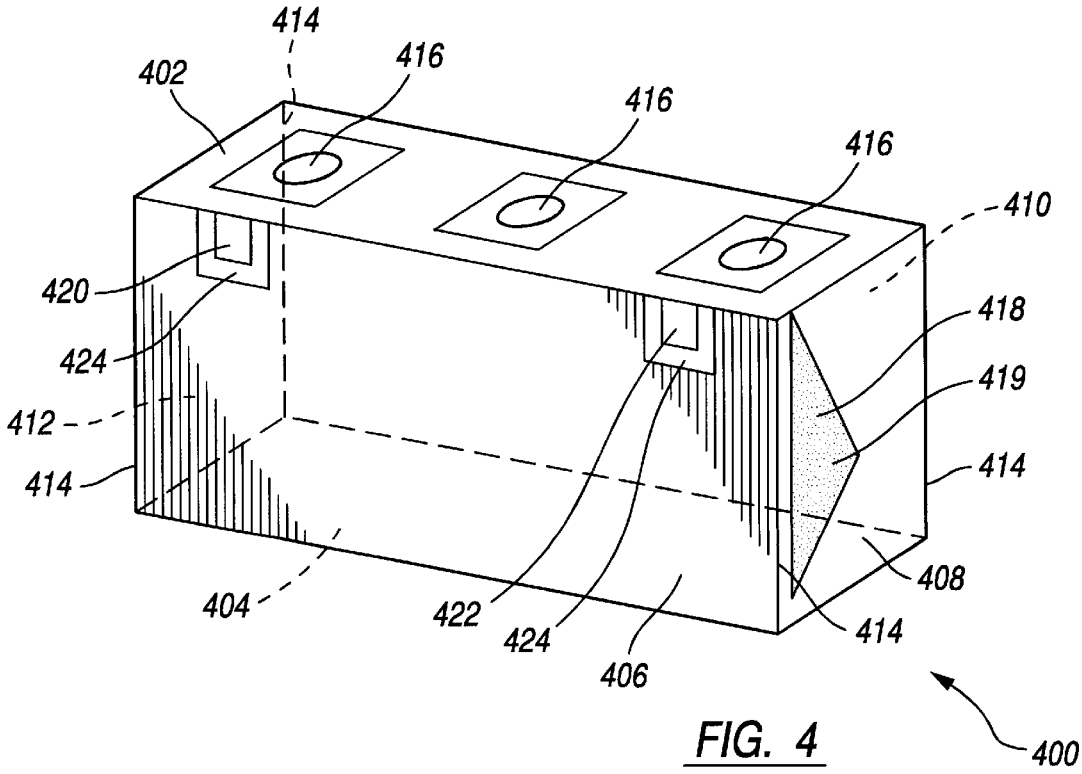
FIG. 4 shows another embodiment of the ceramic transverse-electromagnetic-mode filter having suppression of spurious cavity modes using resistive paste, in accordance with the present invention.

FIG. 4 shows still another embodiment of the present invention in which a resistive paste base 418, and resistive paste layer 419 form a substantially triangular pattern on side surface 408 of filter block 400. Referring to FIG. 4, a ceramic filter 400 is provided. Filter 400 includes a filter body made from a block of dielectric material and having a top surface 402, a bottom surface 404, and four side surfaces 406, 408, 410 and 412 respectively. Filter 400 also includes four vertical edges 414. A plurality of metallized through-holes extending from the top surface 402 to the bottom surfaces 404 define TEM-mode resonators 416.

The external surfaces 404, 406, 408, 410 and 412 are substantially covered with a conductive material defining a metallized layer, with the exception that the top surface 402 is substantially uncoated. Additionally, at least one vertical portion in proximity to the vertical edges 414 of the block 400 on at least one of the side surfaces is unmetallized defining a resistive paste base 418. The resistive paste base is in a triangular pattern on side surface 408 of the dielectric filter 400

The resistive paste base 418 extends substantially vertically in proximity to the vertical edges 414 of the block 400 and with a substantially triangular pattern. Resistive paste base 418 has a substantially elongated triangular shape and extends substantially parallel to the resonators 416 a distance sufficient to attenuate a set of parasitic spurious responses in the filter frequency response curve while simultaneously maintaining a desired TEM-mode passband (see FIG. 6 discussed below).

The shape of any resistive paste base 418 and corresponding resistive paste layer 419 will depend on a variety of factors and will be different for many different filtering applications. Whereas a standard rectangular or triangular or trapezoidal design may be easily applied with conventional screen printing techniques, the resistive paste pattern design will be dependent on the specific design of the filter and the desired resistance values. Typically, the required paste resistivity will decrease as the resistive paste base 418 is increased and as the distance it extends down the side surface of the block increases.

Figure 5:
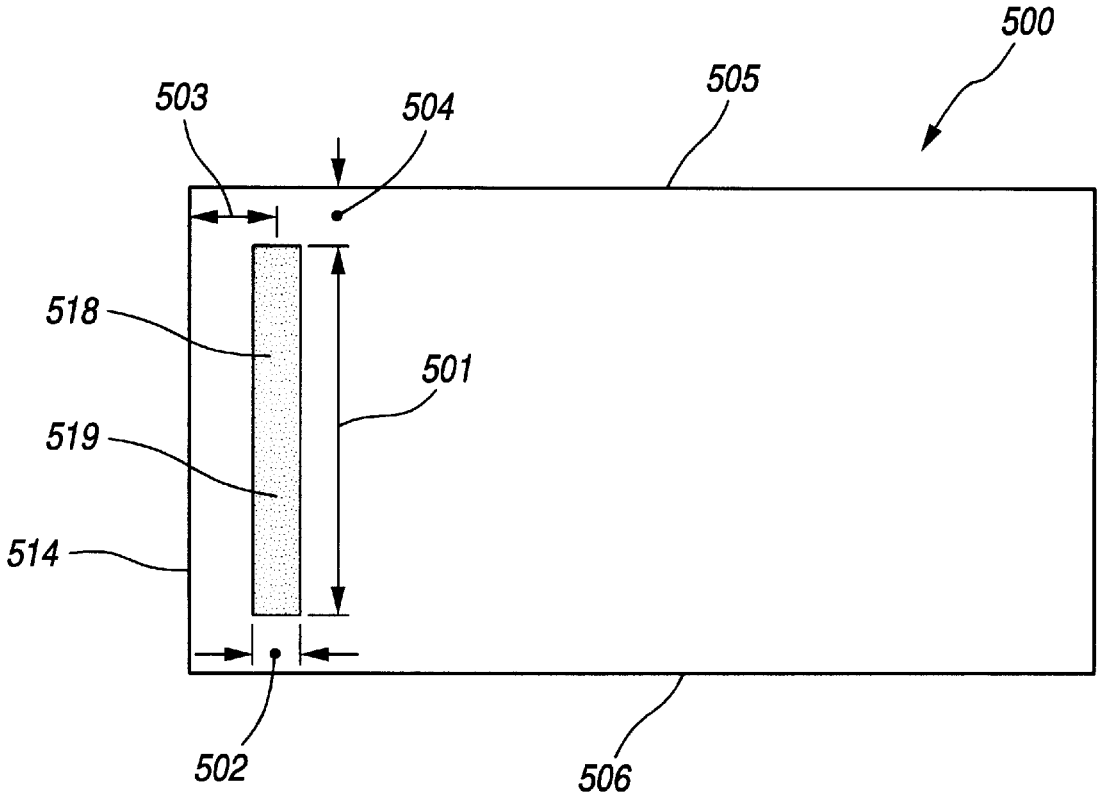
FIG. 5 shows a plan view of a side surface of a ceramic transverse-electromagnetic-mode filter having suppression of spurious cavity modes using resistive paste, in accordance with the present invention.

FIG. 5 shows a plan view of a side surface of a ceramic transverse-electromagnetic-mode filter 500 having suppression of spurious cavity modes using resistive paste, in accordance with the present invention. From this plan view (side view) of the ceramic filter 500, various aspects of the resistive paste base 518 and the resistive paste layer 519 can be evaluated. Numerous design criteria and considerations need to be analyzed before the resistive paste base 518 is achieved by removing metallization and a resistive paste layer 519 is applied.

The area of the resistive paste layer 519 as well as the thickness of the resistive paste layer will determine the resistance value of the material which will effect the electrical properties and performance of the filter. However, an important design consideration involves the placement of the resistive paste layer 519 on the side surface of the dielectric filter block 500. Various options are available as to the placement of the resistive paste layer, and certain of these design parameters are discussed with reference to FIG. 5 below.

Referring to FIG. 5, a side view of filter 500 is provided, with a top surface 505 and a bottom surface 506. A resistive paste base 518 is first applied to the surface of the filter 500 and a resistive paste layer 519 is subsequently applied immediately on top of the resistive paste base 518. One important design parameter is the length of the resistive paste layer 501 as well as the thickness of the resistive paste layer 502. Other important design parameters are the distance of the resistive paste layer 519 from the top surface 505 of the filter 500. This distance is shown in FIG. 5 as 504. Additionally, the distance of the resistive paste strip 518 from a vertical edge 514 of the filter 500 is provided as 503 in FIG. 5.

In addition to the resistive properties of the resistive paste materials, other factors which may effect the suppression characteristics of the filter include the placement of the resistive paste layer on the side surface of the filter block, the size and shape of the resistive paste layer, and the resistivity of the resistive paste material.

Figure 1:
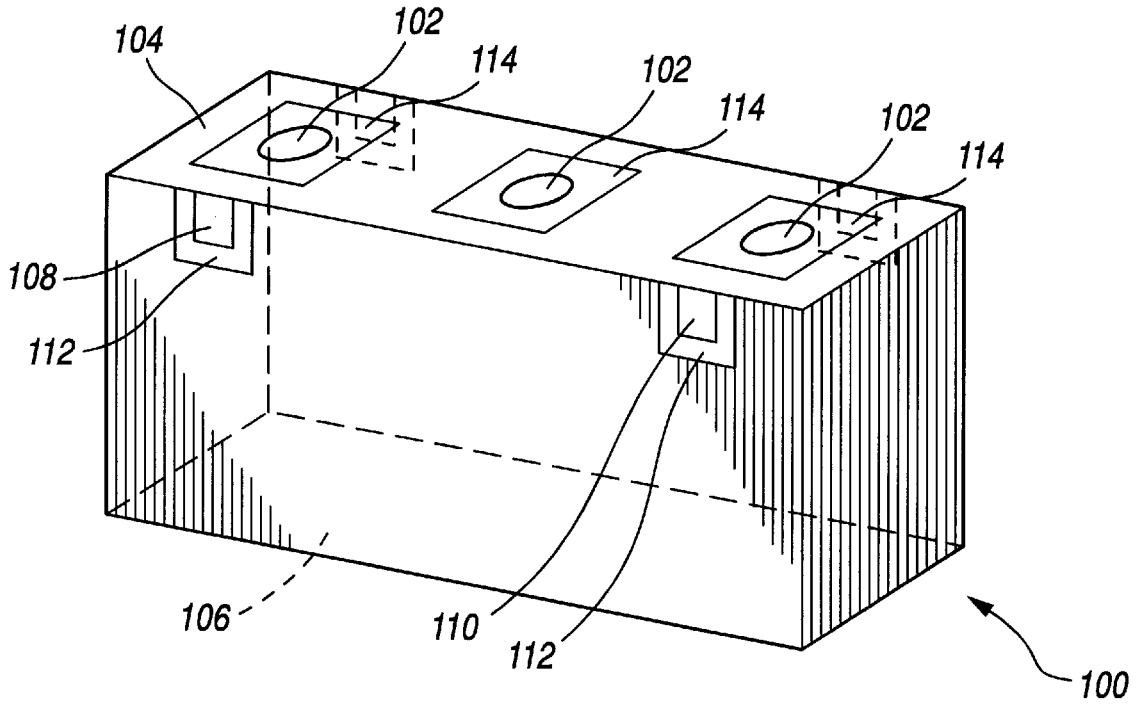
FIG. 1 PRIOR ART
FIG. 1 shows a prior art dielectric ceramic monolithic block filter.
Figure 6:
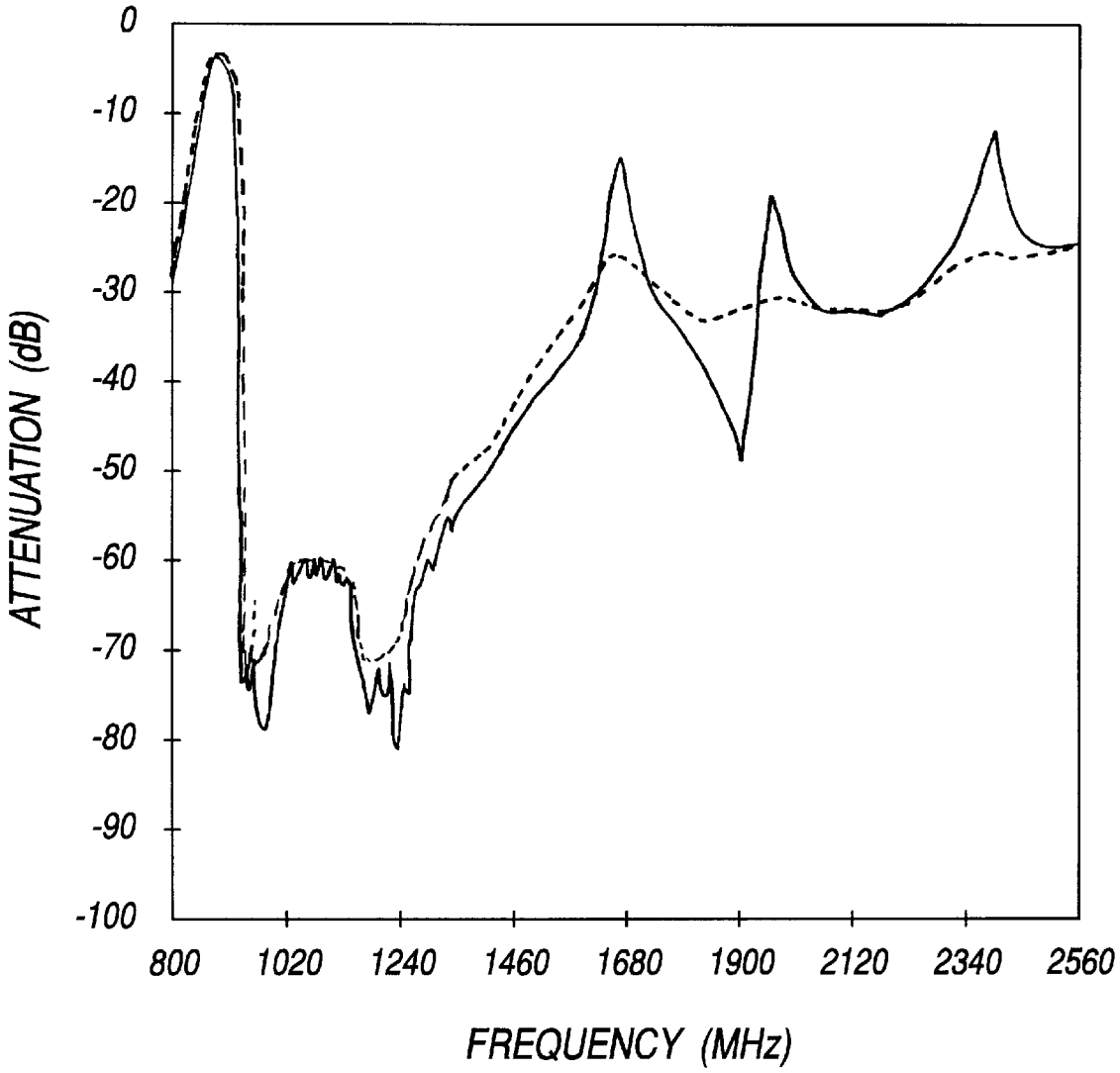
FIG. 6 shows a graph of the insertion loss versus frequency for a ceramic transverse-electromagnetic-mode filter both with and without resistive paste for suppression of spurious cavity modes from a computer simulation.

In one embodiment of the present invention, the resistive paste material will have a resistance value of about 10 to 300 ohms per square. In other embodiments, the resistance values will vary between about 1 and 1000 ohms per square. The material resistance value of the resistive paste material will depend primarily on the paste ingredients and steps may be taken to optimize the electrical properties of the paste FIG. 6 shows a graph of the insertion loss versus frequency for a prior art filter (without the resistive paste layer) and a filter of the present invention (with the resistive paste layer). In FIG. 6, a prior art filter, such as the one shown in FIG. 1, may have a frequency response as shown by the solid line. Without the resistive paste layer (219 in FIG. 2, 319 in FIG. 3, 419 in FIG. 4, and 519 in FIG. 5), the filter will have various spikes in the frequency response at the numerous higher order modes. Referring to FIG. 6, the Attenuation values, measured in decibels (dB), vary between zero and (−100 dB). The frequency, measured in megahertz, vary between 800 and 2560 MHz. Note that the various spikes in the frequency response curve of the prior art filter (solid line) occur at about 1680 MHz, 2000 MHz, and 2400 MHz, respectively.

Now referring to the frequency response curve for a filter having a resistive paste layer, shown as a dashed line in FIG. 6, the result is changed significantly with the addition of the resistive paste layer feature. A frequency response curve for a filter having a resistive paste layer, as shown in FIG. 2 for example, will have a significantly attenuated frequency response curve. It is important to note that the addition of the resistive paste serves to attenuate the frequency response significantly, while leaving the design passband virtually unchanged. As a result, a more desirable filter frequency response is achieved. The ability to attenuate unwanted parasitic passbands is a valuable design tool for radio frequency design engineers.

Applicants postulate that the presence of stray spurious signals in the form of unwanted passbands in the filter frequency response curve in the region of the second and third harmonics is due to the existence of waveguide resonant modes in addition to the TEM-mode which defines the passband of interest (also called the design passband). These unwanted passbands are in addition to a natural TEM second passband which is at about the third harmonic or higher.

The insertion of a resistive paste base, in the form of a small vertical unmetallized area on a side surface of the block is believed, by the applicants, to stretch the waveguide cavity mode current path. The subsequent addition of a resistive paste layer causes the attenuation of these unwanted passbands (spurious signals). Stated another way, the purposefully inserted resistive paste base and resistive paste layer creates an energy absorbing obstruction to the path of the waveguide resonant mode currents which propagate on the metallized surfaces of the filter blocks.

One important aspect of the present invention is that by strategically placing the resistive paste layer on a side surface of the filter block, away from the resonators, the TEM-mode currents are virtually unaffected. Thus, the passband of interest remains virtually unchanged, while the unwanted passbands can be substantially attenuated. Referring to FIG. 6, some of the spurious peaks (spikes) are attenuated about 10 dB or more.

This feature (the resistive paste layer) of the present invention gives a designer more options in the design of filters and also gives the designer another method to meet difficult specifications. Moreover, since waveguide modes have a maximum current flow at the edges, the strategic placement of the resistive paste layer near the vertical edges of the block effectively absorbs this flow and creates an attenuation of the spurious parasitic responses.

It is significant to note that when the resistive paste layer is properly placed on a side surface of the filter block, the resistive paste layer will effect all waveguide cavity modes. By creating a resistive paste layer, the resonant frequencies of all cavity modes whose current distribution is disturbed by the resistive paste layer are attenuated. This does not mean, however, that all modes are attenuated the same amount. The extent to which each mode will be attenuated will depend on numerous other design variables.

The application of waveguide cavity mode theory to a monolithic block filter having resonators which are known to operate in TEM-mode is a new and unusual approach to a known problem. This becomes more apparent as attempts are made to model the behavior of electromagnetic fields in the filter block itself. These inventors have found that while the TEM-mode characteristics are strongly dependent upon design parameters such as size, location, and spacing of the resonator through-holes, the waveguide cavity mode characteristics are relatively standard and somewhat independent of these variables. As such, a relatively simple design feature such as the resistive paste layer may cause an enormous interruption in the waveguide characteristics of the TEM-mode filter.

The waveguide resonance modes are excited and coupled into the final filter response through the filter input and output pads as well as by the metallized top-print patterns near the open end of the TEM-mode resonators. As such, at the input and output ports, modeled simulations show both TEM-mode and waveguide resonance mode characteristics.

The use of a resistive paste layer on a side surface of a monolithic block of ceramic is an entirely new method of addressing the problem of unwanted passbands. Formerly, methods of removing unwanted passbands oftentimes resulted in additional components and complexity and invariably changed the design passband as well. The use of a resistive paste layer to attenuate unwanted passbands has the advantage of leaving the design passband unchanged. This allows a designer to meet specifications in a two step process. First, the design passband is achieved, then the unwanted passbands are attenuated to a region where they are non-obstructive.

Significantly, the physical size of the resistive paste layer effects the extent to which the unwanted passbands will be attenuated. Generally, the larger the void the greater the attenuation. With certain designs, it may even be possible to attenuate the frequency 10 to 20 decibels or more. The physical size of the resistive paste layer is usually increased by extending its length down the side surface of the filter block while maintaining a constant width in the void. Other ways of increasing the physical size of the resistive paste layer is to provide an elaborate tapered or triangular design on the side surface of the filter block. The ultimate goal is to increase the absorption of the waveguide mode currents.

Still another technique used to cause a greater attenuation of the unwanted passbands is to introduce additional resistive paste layers on the same or other side surfaces of the filter block. In a preferred embodiment, a single resistive paste layer will provide all the desired attenuation of the unwanted passbands.

However, in other embodiments, two or more resistive paste layers may be introduced, on various side surfaces, to further absorb the waveguide cavity mode currents and consequently cause an even greater attenuation of these unwanted passbands (spurious signals). In fact, for larger filter blocks, it may be necessary to place additional resistive paste layers on the surface of the filter block to effectively attenuate all the unwanted passbands.

The existence of spurious parasitic responses has been a challenge to filter designers for some time. Traditionally, they have been analyzed using conventional TEM-mode modeling and analysis. Whereas conventional transmission line filters repeat themselves at periodic controllable intervals from a fundamental frequency, this does not explain the presence of spurious parasitic responses in the filter response. The present invention suggests dual TEM-mode and waveguide mode phenomena occurring inside the filter block to explain the presence of unwanted passbands.

By recognizing that the introduction of resistive paste layer, or more specifically, the removal of a pre-existing layer of metallization in a specific region of the block and a subsequent application of a resistive paste layer thereon, affects the frequency of unwanted passbands, this phenomenon may be utilized to accurately tune the filter itself. A method of tuning a dielectric block filter which comprises multiple steps may be established. First, the desired design passband is established. This may be accomplished using conventionally known and established tuning techniques such as removing electrode material from an edge defined by the top surface of the filter block and a resonator through-hole. This affects the loading of the filter and, under traditional transmission line theory, provides a passband.

Next, the passband must be manipulated to meet the desired specifications and achieve a desired profile. This is accomplished by repeating for each resonator the step described above until a desired TEM-mode passband is achieved.

Once the desired passband is obtained, the issue of parasitic passbands (undesired spurious responses) can then be addressed. It is at this point that the resistive paste base may be placed on a side surface of the filter block by removing the metallization material from a side surface substantially vertically in proximity to the vertical edges of the block to provide a resistive paste base. On top of the resistive paste base, a resistive paste layer may be uniformly applied to the surface of the filter immediately on top of the resistive paste base.

Next, the effect of the resistive paste layer can be measured by checking a frequency response curve of the filter to confirm that the introduction of the resistive paste base and resistive paste layer actually attenuates a set of parasitic passbands by a predetermined amount while simultaneously maintaining a desired TEM-mode passband.

The tuning process continues when the size of the resistive paste layer is enlarged, typically by lengthening the resistive paste base, until all unwanted parasitic passbands are attenuated to meet a predetermined filter specification. Of course, once an optimal design has been achieved for a given set of specifications, the resistive paste resistivity and layer dimensions may be measured and a similarly sized resistive paste layer may be applied to subsequent blocks via other methods such as screen-printing, patterning, or other deposition techniques. Thus, the present invention provides a method of tuning TEM-mode filters to attenuate unwanted parasitic passbands.

The present invention postulates that waveguide mode paths, inside the filter block itself, may be the cause of these parasitic spurious responses. The open top surface of a conventional prior art high dielectric ceramic filter acts as a magnetic wall and, from a modeling perspective, provides a surface for the total reflection of waveguide modes, which can also be regarded as a mirror-imaging surface. As such, the computer models used to simulate the flow of current through the block, in the waveguide mode, contemplate a block of twice the volume of the actual monolithic ceramic filter.

This concept may be more easily understood with reference to a set of formulas and equations which may better explain the postulated electromagnetic field modes in the filter block.

The formula for the cavity resonant frequency is a modified version of the classical formula for a rectangular box and is shown as:

$$f_{res} = \frac{c}{2}\sqrt{\left(\frac{m}{L}\right)^2 + \left(\frac{n}{2h}\right)^2 + \left(\frac{p}{w}\right)^2} \tag{1.1}$$

where $$c = 3.0 \times 10^8 / \sqrt{\varepsilon_r} \text{ meters/second} \tag{1.2}$$

and where:

$f_{res}$=the resonant frequency;

c=the TEM wave velocity in the ceramic material;

w=the block width (see FIG. 2A);

L=the length of the filter block (see FIG. 2A);

h=the height of the block (see FIG. 2A);

m,n,p=non-negative integers of which at least two must be positive and where n must be an odd number;

$\epsilon_r$=the relative permittivity of the ceramic material.

Referring to equation (1.1) above, as the width (w) dimension becomes substantially less than the height (h) and length (L) dimensions in a filter block, the "p" value is set at zero and the "n, m" values become positive integers for the lowest resonant frequencies. Moreover, the addition of shielding may shift the resonant cavity mode frequency upward.

Although various embodiments of this invention have been shown and described, it should be understood that various modifications and substitutions, as well as rearrangements and combinations of the preceding embodiments, can be made by those skilled in the art, without departing from the novel spirit and scope of this invention.

What is claimed is:

1. A ceramic filter, comprising:

a filter body comprising a block of dielectric material and having top, bottom and four side surfaces including vertical edges, and having a plurality of metallized through-holes extending from the top to the bottom surfaces defining transverse-electromagnetic-mode resonators, the surfaces being substantially covered with a conductive material defining a metallized layer, with the exception that the top surface is substantially uncoated, and with an additional exception that at least one vertical portion in proximity to the vertical edges of the block on at least one of the side surfaces is unmetallized defining an unmetallized base;

the unmetallized base extending substantially vertically in proximity to the vertical edges of the block starting at a top edge of the block and extending a distance downwardly so as to attenuate a set of parasitic harmonic spurious passband responses in the filter frequency response curve while simultaneously maintaining a desired transverse-electromagnetic-mode passband;

a layer of resistive paste of predetermined resistivity deposited immediately on top of the unmetallized base; and first and second input-output pads comprising an area of conductive material on at least one of the side surfaces and substantially surrounded by an uncoated area of the dielectric material.

2. The filter of claim 1, wherein the unmetallized base extends from the top surface of the block to about one-half way down one of the side surfaces of the block and has a substantially uniform width.

3. The filter of claim 1, wherein the unmetallized base is on one side surface the filter block and a second unmetallized base is on an opposite side surface of the filter block, both unmetallized bases having a substantially uniform width.

4. The filter of claim 1, wherein the unmetallized base is on one side surface the filter block and a second unmetallized base is on the same side surface of the filter block, both unmetallized bases having a substantially uniform width.

5. The filter of claim 1, wherein the layer of resistive paste attenuates a second natural passband.

6. The filter of claim 1, wherein the layer of resistive paste has a value of about 1 to 1000 ohms per square.

7. The filter of claim 1, wherein the layer of resistive paste is comprised of a carbon-graphite material.

8. The filter of claim 1, wherein the unmetallized base is tapered such that the base is wider at a position distant from the top surface of the a block of dielectric material.

9. The filter of claim 1, wherein the unmetallized base is triangular in shape.

10. The filter of claim 1, wherein the unmetallized base is trapezoidal in shape.

11. The filter of claim 1, wherein the layer of resistive paste of predetermined resistivity is non-uniform and comprises resistivity gradients.

12. A method of tuning a dielectric ceramic block filter comprising the steps of:

removing metallization material from an edge defined by the top surface of the filter block and a resonator through-hole;

repeating for each resonator until a desired transverse-electromagnetic-mode passband is achieved;

removing metallization material from a side surface substantially vertically in proximity to the vertical edges of the block and starting at a top edge of the block so as to provide an unmetallized base;

applying a layer of resistive paste material immediately on top of the unmetallized base;

checking a frequency response curve of the filter to confirm that the introduction of the layer of resistive paste attenuates a set of parasitic harmonic passbands while simultaneously maintaining a desired transverse-electromagnetic-mode passband; and enlarging the size of the unmetallized base;

applying a layer of resistive paste material to the unmetallized base until all unwanted parasitic harmonic passbands are attenuated to meet a predetermined filter specification.

13. A ceramic duplex filter, comprising:

a filter body comprising a block of dielectric material and having top, bottom and four side surfaces including vertical edges, and having a plurality of metallized through-holes extending from the top to the bottom surfaces defining transverse-electromagnetic-mode resonators, the surfaces being substantially covered with a conductive material defining a metallized layer, with the exception that the top surface is substantially uncoated, and with an additional exception that at least one vertical portion in proximity to the vertical edges of the block on at least one of the side surfaces is unmetallized defining an unmetallized base;

the unmetallized base extending substantially vertically in proximity to the vertical edges of the block and with a substantially uniform width starting at a top edge of the block and extending a distance downwardly so as to attenuate a set of parasitic harmonic spurious passband responses in the filter frequency response curve while simultaneously maintaining a desired transverse-electromagnetic-mode passband;

a layer of resistive paste of predetermined resistivity deposited immediately on top of the unmetallized base; and first and second and third input-output pads comprising an area of conductive material on at least one of the side surfaces and substantially surrounded by an uncoated area of the dielectric material.

* * * * *